United States Patent [19]

O'Connor

[11] Patent Number: 4,815,891

[45] Date of Patent: Mar. 28, 1989

[54] METHOD FOR REPAIRING AN OPENING FORMED IN AND BELOW A SECTION OF PAVEMENT

[75] Inventor: Patrick L. O'Connor, Dryden, Mich.

[73] Assignee: Thermal Power Corporation, Almont, Mich.

[21] Appl. No.: 159,463

[22] Filed: Feb. 19, 1988

Related U.S. Application Data

[63] Continuation of Ser. No. 907,656, Sep. 15, 1986, abandoned, and a continuation-in-part of Ser. No. 133,192, Dec. 15, 1987, and Ser. No. 142,313, Dec. 29, 1987, said Ser. No. 133,192, is a continuation of Ser. No. 665,286, Oct. 26, 1984, abandoned, said Ser. No. 142,313, is a continuation of Ser. No. 665,287, Oct. 26, 1984, abandoned.

[51] Int. Cl.[4] ..... E01C 21/00

[52] U.S. Cl. ..... 404/77; 404/82

[58] Field of Search ..... 404/77, 79, 80, 82, 404/95; 431/165, 328; 126/271.2 A; 501/80

[56] References Cited

U.S. PATENT DOCUMENTS

| | | | |
|---|---|---|---|
| Re. 12,077 | 2/1903 | Perkins | 404/77 |
| 1,230,894 | 6/1917 | Harrop | 404/79 |
| 1,399,681 | 12/1921 | Austin | 404/77 |
| 1,462,851 | 7/1923 | Cooper | 404/77 |
| 1,512,125 | 10/1924 | Mende | 404/79 |
| 2,194,208 | 3/1940 | Moran | 431/328 |
| 2,311,350 | 2/1943 | Richardson | 431/165 X |
| 2,828,813 | 4/1958 | Holden | 431/328 |
| 3,008,513 | 11/1961 | Holden | 431/328 |
| 3,010,177 | 11/1961 | Thompson et al. | 501/80 X |
| 3,270,632 | 9/1966 | Schultz | 404/77 |
| 3,970,404 | 7/1976 | Benedetti | 404/77 |
| 3,989,401 | 11/1976 | Moench | 404/95 |
| 4,457,703 | 7/1984 | Ross | 431/328 X |
| 4,601,605 | 7/1986 | Damp et al. | 404/77 X |

OTHER PUBLICATIONS

Utility Cut Restoration Problems and a New Policy, Metropolitan Toronto Roads and Traffic Department, Apr. 1985.

TRB Focuses on New Technology, Better Roads, Feb. 1986, pp. 44–46, Utility Cut Restoration, APWA Reporter, Aug. 1986, pp. 12–13.

Rules and Regulations to Control Street Cuts for City of Ann Arbor, MI., Mar. 1975, Beating the Menace of Smoke and Fumes, F. O'Shanohun Associates Lim., Sep. 1967.

Rules and Regulations for New Asphaltic Concrete Pavement for City of Warren, MI.

*Primary Examiner*—Jerome W. Massie
*Assistant Examiner*—Matthew Smith
*Attorney, Agent, or Firm*—Brooks & Kushman

[57] ABSTRACT

A method for repairing an opening formed in and below a section of pavement, comprising the steps of partially filling the opening with an unshrinkable filler material such that an upper surface of the filler material is near a lower surface of the section of pavement, heating an upper portion of the filler material so that the upper portion is substantially dried and becomes set, and substantially immediately thereafter making a permanent patch in the pavement section above the dried filler material.

10 Claims, 1 Drawing Sheet

METHOD FOR REPAIRING AN OPENING FORMED IN AND BELOW A SECTION OF PAVEMENT

This application is a continuation of Ser. No. 907,656, filed 9-15-86, abandoned, and a continuation-in-part of both applicant's copending U.S. patent application Ser. Nos. 133,192, filed 12-15-87 and 142,313, filed 12-29-87, , and respectively entitled "SURFACE HEATER VEHICLE" and "ASPHALT REPAIR APPARATUS", which are continuations of Ser. Nos. 665,286, and 665,287, respectively, both filed 10-26-84 and both abandoned.

BACKGROUND OF THE INVENTION

1. Field of the Invention

The present invention relates generally to a method for repairing openings formed in and below sections of pavement, and more particularly to an immediate and permanent method for making such repairs.

2. Description of the Relevant Art

In the art of road (or pavement) making and repair, there is a universally acknowledged problem associated with the fact that utility companies are very often required to cut openings in roads, sidewalks, etc. so that they can insert (or fix defective) utility lines thereunder.

The problem with utility cuts is many fold. First of all, the utility companies, or the contractors they have hired, very often (at least 50% of the time) improperly restore the utility cuts after they have finished inserting or repairing the utility lines. This is primarily due to the fact that the utility companies or their contractors fail to follow the established engineering guidelines for backfilling the portion of the utility cut below the pavement with a granular backfill material. Normally, the utility companies fail to compact the backfill material to a sufficient degree (guidelines require that the material be compacted to at least 95% of its maximum unit weight), whereby the backfill material will settle over a period of time, creating relatively large voids between the backfill material and a pavement patch which has been placed thereover. This, in turn, leads to cracking, buckling and settling of the pavement patch, whereby it becomes difficult to travel on, and water is permitted to flow beneath the pavement where it does further extensive damage to surrounding subgrade (base) and pavement structure. Improper compaction is particularly prevalent with small utility repair cuts, i.e., less than 1.25 meters in width.

A second and related part of the problem is the fact that the utility companies and their contractors often fail to correct voids created below the pavement surrounding the utility cuts as a result of subgrade material falling away from the sides of the excavation. The accepted solution to this "overbreaking" problem is to cut back a portion of the pavement surrounding the original utility cut so that these voids are fully exposed and can be eliminated. However, the utility companies and their contractors often omit this important cutting back step because it is cheaper and easier for them to do so.

A third major part of the problem is the fact that after the backfill material has been inserted and compacted, the pavement (whether rigid concrete or flexible asphalt) above the backfill material is not permanently repaired. Rather, it is merely temporarily patched, such as with a "cold" asphaltic mixture, while a permanent patch is not made until several months later. Temporary patches are used primarily because backfilling materials do tend to settle to some degree (even if properly compacted) under the weight of the vehicles traveling over the pavement, and it is desirable to have the backfilling or subgrade materials completely settled before applying a permanent patch. Other reasons for temporary patching are (1) the fact that permanent patches cannot be made during the winter months or under severe weather conditions using conventionally available equipment, and (2) permanent (or hot) asphaltic materials are not available from asphalt manufacturers during winter months.

Unfortunately, temporary patches are of very low quality in comparison to permanent patches due to the fact that the temporary patch mixture fails to sufficiently bond to either the surrounding pavement or to itself. As a result, temporary patches become cracked, broken and eventually displaced under use, whereby they must be continually policed and often replaced (usually by local authorities) before the permanent patch is made. (It is not unusual to temporarily patch the same utility cut as many as 12 times during the course of a winter!) Thus, as the temporary patch degrades and becomes displaced, water, salt, etc. are permitted to freely flow into the utility cut where these elements do extensive damage to the surrounding subgrade and pavement structure.

The cost to every tax-paying, vehicle-driving person as a direct result of the overall utility cut problem is tremendous. For example, a study by the Army Corps of Engineers showed that ". . . on the average, streets without utility cut patching have a life of 20 years, whereas streets with utility cut patching have a life of 12 years." See an article entitled TRB Focuses on New Technology in the February 1986 issue of Better Roads Magazine pages 44 and 45. As a result of this shortened road life, new roads must be built prematurely. Premature road construction in the United States and Canada cost taxpayers several billion dollars annually. See for example a study entitled "Utility Cut Restorations Problems and a New Policy" published in April 1985 by the Metropolitan Toronto Roads and Traffic Department, wherein it is discussed that premature road construction in Toronto alone costs 3 million dollars annually. Additionally, utility cut restorations put a great financial burden on governments in the sense that they must continually police and do periodic maintenance on the restorations, either because the pavement patches are temporary (and expected to fail) or because of improper backfilling by the utility companies.

Furthermore, it has been shown that some local governments spend as much, if not more, in liability exposure due to the poor condition of roads (resulting to a substantial degree from the utility cuts) than they spend actually fixing the roads.

On a personal level, the maintenance costs of vehicles are increased, while the life expectancy of the vehicles is decreased, due to the utility cut problem. Also, the pavement defects resulting from utility cuts are a major public nuisance. "In addition to their visual appearance, depressions in the pavement due to settlement promote the ponding of water. The subsequent splashing of pedestrians and private property from passing vehicles results in cleaning bills, salt damage to plant life, and rust and rot damage to metal and wood fences and structures." See the Toronto study on utility cut restoration, discussed above.

In an effort to abate the first and second parts of the utility cut problem discussed above, some local governments have recently adopted the use of "unshrinkable fill" as a substitute for granular backfill materials. Unshrinkable fill is basically a weak, loosely-cemented, concrete material which can be poured in place. The material is self-compacting, and voids around the lip of an excavation caused by overbreaking are automatically force filled by the fluid nature of the material. Unshrinkable fill is at least as effective as properly compacted granular fill in providing a stable subgrade, and because it is loosely-cemented it can be easily excavated without mechanical assistance if future access to the buried utility lines is required. Under favorable conditions (sunny and warm), the unshrinkable fill sets up in as little as one hour, after which time a temporary patch is made in the pavement according to conventional practices. See the Toronto study on utility cut restoration. Temporary patches are used for substantially the same reasons as discussed above with respect to compacted, granular backfill, i.e., it is desired to wait for the filler material to completely settle before making a permanent patch, and it is often not possible to make permanent patches due to weather conditions.

This effort has been successful, but because it fails to address the entire utility cut problem, the third and very significant part of the problem remains.

Also, the fact that it takes at least one hour for the unshrinkable fill to set up is significant because the utility companies or their contractors making the repairs will not wait around during this time because it is prohibitively expensive to do so. Rather, metal or plastic sheets will be placed over the utility cut if the roadway in which the cut is made is required for immediate use, or the cut will be left open and barricaded if the roadway is not needed for immediate use.

SUMMARY OF THE INVENTION

The present invention has been developed to completely overcome the problems and disadvantages of the conventional methods for repairing utility cuts in pavement.

Applicant has determined that unshrinkable filler material, as discussed above, can be quickly and effectively prepared as a stable subgrade base for a permanent pavement patch by heating an upper portion of the unshrinkable filler material after it has been poured into a utility cut (or other opening) so that the upper portion dries and sets.

According to the present invention there is provided a method for repairing an opening formed in and below a section of pavement, comprising the steps of partially filling the opening with an unshrinkable filler material such that an upper surface of the filler material is near a lower surface of the section of pavement, heating an upper portion of the filler material so that the upper portion is dried and sets, and substantially immediately making a permanent patch in the pavement section above the dried, filler material.

It is an object of the present invention to overcome the entire problem of utility cuts by providing a method through which the utility cuts can be immediately, permanently repaired.

It is a further object of the present invention to provide such a method, and in which the quality of the pavement after the repair is at least as good as the quality of the pavement before the utility cut was made.

It is another object of the present invention to provide such a method, and which can be performed year-round and under all weather conditions.

Other objects, advantages and salient features of the present invention will become apparent from the following detailed description, which when taken into conjunction with the annexed drawings discloses a preferred embodiment of the present invention.

DETAILED DESCRIPTION OF THE PREFERRED EMBODIMENT

Figure 1:
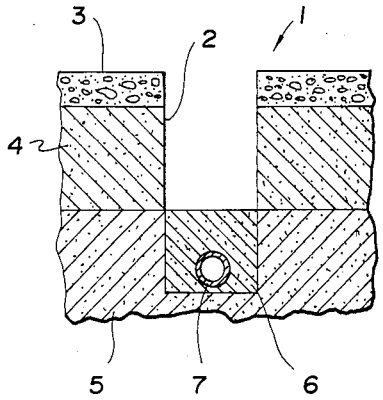
FIGS. 1–6 illustrate the stages of a preferred embodiment of the present invention for repairing a utility cut or opening.

Referring to FIG. 1, there is shown a typical cross section of a metropolitan arterial road 1 having a utility cut or opening 2 formed therein. The road includes an upper pavement section 3 and a compacted, granular subgrade (or base) section 4 positioned above an earth or parent section 5. The pavement section may be brick or concrete (rigid), asphalt (flexible), or an asphalt overlay on top of a concrete or brick base. A utility line 7 is shown situated in the parent section 5, but could alternately be situated in the subgrade section 4. The utility line 7 is surrounded by a bedding material section 6, i.e., sand, which can prevent shifts in the road or earth from damaging the utility line.

Figure 2:
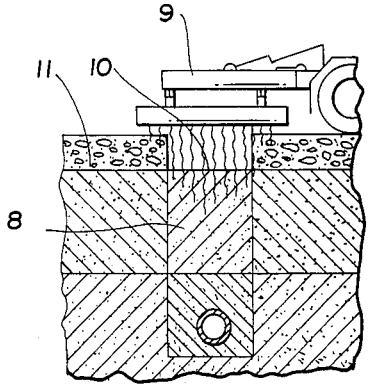

Referring to FIG. 2, the utility cut has been partially filled with an unshrinkable filler material 8 such that the upper surface 10 of the filler material is near the lower surface 11 of the pavement. Thereafter, the filler material 8 is heated, preferably using a radiant-type heating means 9, so that an upper portion of the filler material is dried and becomes set. The dried upper material 8 of the filler portion should be sufficiently thick to substantially prevent any subsequent settling of the filler material 8. Normally a minimum thickness of 8 inches is sufficient. The heater means 9 should be capable of drying the upper portion of the filler material 8 in at most a half hour (preferably in 20 minutes or less) year-round and under any weather conditions. This is a very practical consideration because, as discussed above, repair crews cannot be expected to stand idly around for any extended length of time waiting for the filler material to dry.

A preferred heater means is a movable, luminous wall-type heater panel mounted on a transportable support. Such luminous wall heater means are disclosed in applicant's copending U. S. patent application Ser. Nos. 665,286 and 665,287, both filed Oct. 26, 1984, and respectively entitled "SURFACE HEATER VEHICLE" and "ASPHALT REPAIR APPARATUS"This type of heater means is preferred for many reasons. First of all, it can provide a high, uniform and radiant heat output, whereby it will not tend to scorch or degrade the material which it is heating, even at a relatively high output. Secondly, it includes means for precisely controlling the heat output over a relatively large range, i.e., from 30,000 BTU/ square ft. 60,000 TU/ square ft., whereby it can be efficiently adjusted for use year-round and under any weather conditions. Furthermore, it is built to withstand the rigors of field use and transportation. This advantage is due primarily to the fact that applicant's luminous wall heater panels according to the discussed copending applications include porous firebricks which are not formed with the gas distribution holes conventionally associated with luminous wall heaters, and that the housing supporting the firebricks is very rigidly constructed.

It is possible to heat/dry the upper portion of the unshrinkable filler material 8 by simply allowing it to stand exposed to environmental conditions. This is particularly true under hot and sunny conditions. However, this approach is necessarily more time consuming than using the heating means 9 and, therefore, not practical in most situations. Also, if the weather conditions are unfavorable, i.e., cold and/or raining, this approach is not possible at all.

Substantially immediately after the upper portion of the unshrinkable filler material 8 has been sufficiently dried and becomes set, a permanent patch is made in the pavement to complete the repair.

If the pavement is rigid, i.e., concrete or brick, the permanent patch is made according to conventional procedures. However, it may be necessary or desirable to use the heating means 9 to ensure conditions favorable to the conventional procedures.

Figure 3:
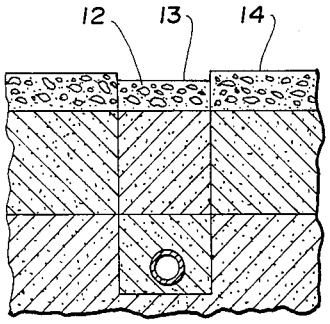

If the pavement is flexible (asphalt) the permanent patch is made substantially in the manner depicted in FIGS. 3–6. Initially, an amount of "hot mix" asphalt 12 is placed in the utility cut 2 above the dried upper portion of the unshrinkable filler material 8, and then compacted such that an upper surface 13 of the added asphalt is near, but below an upper surface 14 of the existing pavement section 3, as shown in FIG. 3. Preferably, the upper surface 13 of the added asphalt should be 1–4 inches below the upper surface 14 of the pavement section 3. In accordance with conventional practices, the added asphaltic material 12 should be compacted in stages. For example, after every 4 vertical inches of material has been added. Also, in accordance with conventional procedures, the cut edges of the existing pavement may be cleaned and have a bond coat material applied thereto prior to the addition of the asphalt material 12 for assisting in achieving a strong bond between the existing pavement and the patching material.

Figure 4:
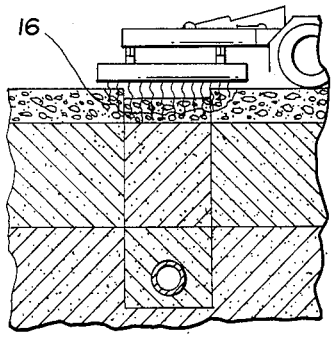
Figure 5:
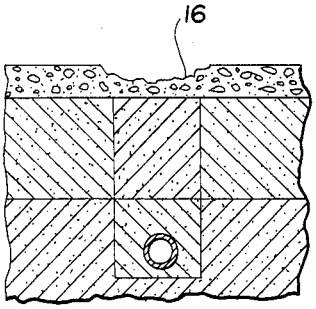

As shown in FIGS. 4 and 5, after the initial addition/compaction, the heating means 9 is used to heat and soften a portion 16 of the pavement section 3 surrounding the utility cut so that this pavement can be scarified. Preferably, the surrounding pavement 16 will be scarified to a minimum of 3 inches from the edges of the utility cut, and to the level of the upper surface 13 of the compacted asphalt material 12, as shown in FIG. 5. The actual scarifying can be achieved using a rake or other appropriate means after the surrounding asphalt material is softened.

Figure 6:
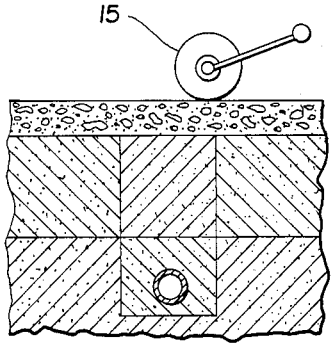

Finally, an additional amount of the "hot mix" asphalt is placed in the utility cut to completely fill same and, as shown in FIG. 6, the added material together with the surrounding scarified pavement is compacted using a roller 15 (or other appropriate compacting means) to achieve a strong bond between the added material and the existing pavement, as well as a smooth, continuous surface. In fact, the quality of pavement after it has been repaired according to the method of the present invention is at least as good as before a utility cut was made therein.

As will be understood from the foregoing, the present invention effectively, completely overcomes the serious problem of utility cuts in pavement by permanently repairing the utility cuts substantially immediately, rather than after a protracted process involving temporary repairs.

Although there has been described what is at present considered to be the preferred embodiment of the present invention, it will be understood that the invention may be embodied in other specific forms without departing from the spirit or essential characteristics thereof. For example, the present invention may be used to repair openings in pavement other than utility cuts, such as potholes, while the repaired section of pavement may not have a continuously flat upper surface, such as a section including a curb. The present embodiment is, therefore, to be considered in all aspects as illustrative, and not restrictive. The scope of the invention is indicated by the appended claims rather than the foregoing description.

I claim:

1. A method for repairing an opening formed in and below a section of pavement, comprising the steps of:

partially filling the opening with a fluid unshrinkable, settable, sub-grade base material, such that an upper surface of the fluid unshrinkable settable base material is substantially co-planar to a lower surface of the section of pavement;

substantially immediately thereafter heating an upper portion of the fluid unshrinkable base material so that the upper portion is dried and becomes set, sufficiently to support the application of asphalt, while the remaining portion remains unset; and substantially immediately thereafter making a permanent patch in the pavement section of the dried upper portion of the unshrinkable base material.

2. A method according to claim 1, wherein:

the upper portion of said filler material has a minimum depth of 8 inches.

3. A method according to claim 2, wherein:

said heating step is achieved within a period of 10–30 minutes under any weather conditions.

4. A method according to claim 2, wherein:

said heating step is achieved within a period of 15–20 minutes under any weather conditions.

5. A method according to claim 2, wherein:

said heating step is effected using a transportable heating means.

6. A method according to claim 5, wherein:

a heat output of said heating means is selectively controllable to be uniformly within a range of 30,000–60,000 BTU/square foot so that said heating step can be achieved within a range of 10–30 minutes under any weather conditions.

7. A method according to claim 5, wherein:

said heating means comprises a luminous wall heater panel having a substantially planar heating surface, and means for positioning the heater panel substantially adjacent to and above said opening;

said luminous wall heater panel including a plurality of porous firebrick; and said firebrick do not have any gas distribution holes formed therein.

8. A method according to claim 1, wherein:

said pavement is rigid pavement.

9. A method according to claim 1, wherein:

said pavement is flexible pavement.

10. A method according to claim 9, wherein:

said permanent patch is made by adding and compacting an amount of softened flexible pavement material in said opening above the dried upper portion of the unshrinkable base material such that an upper surface of the added pavement material is near, but below, an upper surface of the section of pavement; heating and scarifying an upper portion of the section of pavement surrounding said opening; adding an additional amount of softened flexible pavement material to the opening; and compacting the additional material along with the scarified upper portion of the section of pavement, whereby the added pavement material is securely bonded to and continuous with the section of pavement.

* * * * *

UNITED STATES PATENT AND TRADEMARK OFFICE

CERTIFICATE OF CORRECTION

PATENT NO. : 4,815,891

DATED : March 28, 1989

INVENTOR(S) : Patrick L. O'Connor

It is certified that error appears in the above-identified patent and that said Letters Patent is hereby corrected as shown below:

In the Claims

In Claim 2, line 2, delete the word "filler" and insert the words ---unshrinkable base--- therein.

Signed and Sealed this

Seventeenth Day of July, 1990

*Attest:*

*Attesting Officer*

HARRY F. MANBECK, JR.

*Commissioner of Patents and Trademarks*